United States Patent [19]

Laroue

[11] Patent Number: 5,060,319

[45] Date of Patent: Oct. 29, 1991

[54] PORTABLE TOILET SEAT UNIT

[76] Inventor: Michael C. Laroue, 931 S. Ford Blvd., Los Angeles, Calif. 90022

[21] Appl. No.: 625,028

[22] Filed: Dec. 10, 1990

[51] Int. Cl.[5] ..... E03D 11/00; A47K 13/00

[52] U.S. Cl. ..... 4/254; 4/239

[58] Field of Search ..... 4/254, 239, 235, 476, 4/478, 479, 483

[56] References Cited

U.S. PATENT DOCUMENTS

| | | | |
|---|---|---|---|
| 1,004,458 | 9/1911 | Morton | 4/423 |
| 1,638,040 | 11/1926 | Killen | 4/480 |
| 2,513,444 | 12/1948 | Barnes | 155/31 |
| 2,517,755 | 12/1945 | Yumoto | 4/234 |
| 2,712,653 | 9/1950 | Nika | 4/239 |
| 2,719,305 | 10/1952 | Lahue | 4/134 |
| 2,940,086 | 12/1957 | Wondrack | 4/239 |
| 2,955,296 | 5/1958 | Zapolski | 4/239 |
| 2,992,439 | 2/1960 | Van Tassel | 4/239 |
| 3,215,469 | 11/1965 | Wamsley | 4/480 |
| 3,235,884 | 6/1963 | Rehsteiner | 4/134 |
| 3,343,179 | 3/1965 | Sellars et al. | 4/134 |
| 3,371,356 | 5/1965 | Benjamin | 4/239 |
| 3,588,927 | 8/1968 | Springer | 4/239 |
| 4,177,528 | 12/1979 | James | 4/239 |
| 4,381,568 | 12/1981 | Brown | 4/239 |
| 4,777,672 | 10/1988 | Gebhard et al. | 4/239 |

FOREIGN PATENT DOCUMENTS

| | | | |
|---|---|---|---|
| 1166849 | 6/1958 | France | 4/239 |

*Primary Examiner*—Henry J. Recla
*Assistant Examiner*—David J. Walczak

[57] ABSTRACT

A free-standing portable toilet seat unit (18) to be used as an accessory to a conventional flushing toilet (22). The sides of the unit are two vertical parallel slabs (4), and are joined at the front by a shorter vertical front slab (6) and horizontal step (8), and at the top by a seat (12) having a central opening (14) and a semi-annular back rest (16). When placed in position over the bowl (20) of the toilet, the continuous base (10), formed by the lower edges of the three slabs, supports the entire weight of the unit and of a human seated on the unit, directly on the floor so that no weight rests on the toilet itself, whereby maximum stability is provided.

8 Claims, 1 Drawing Sheet

FIG. 1
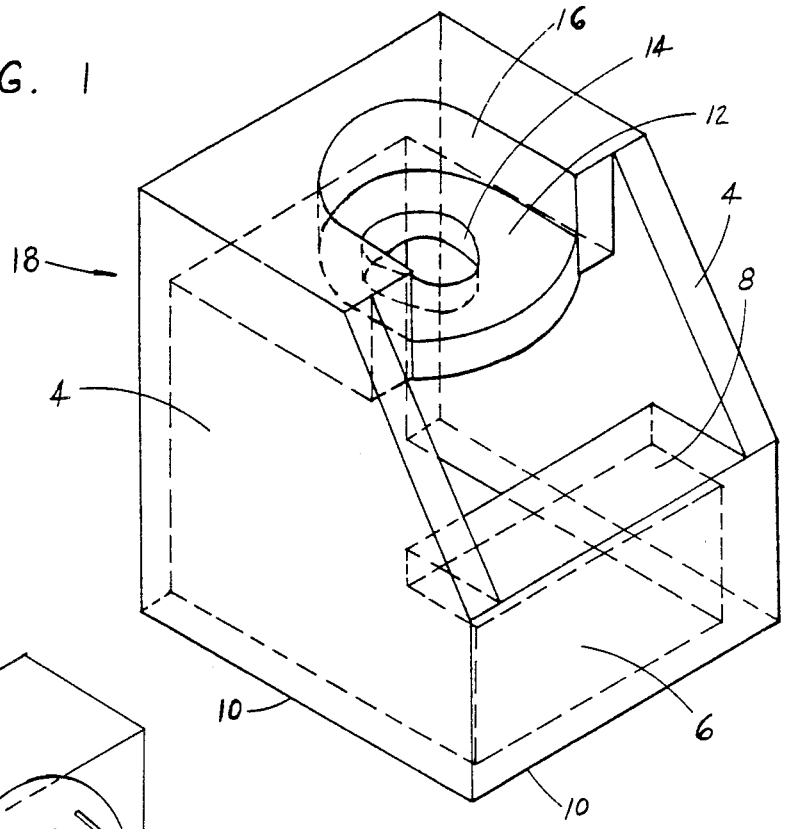
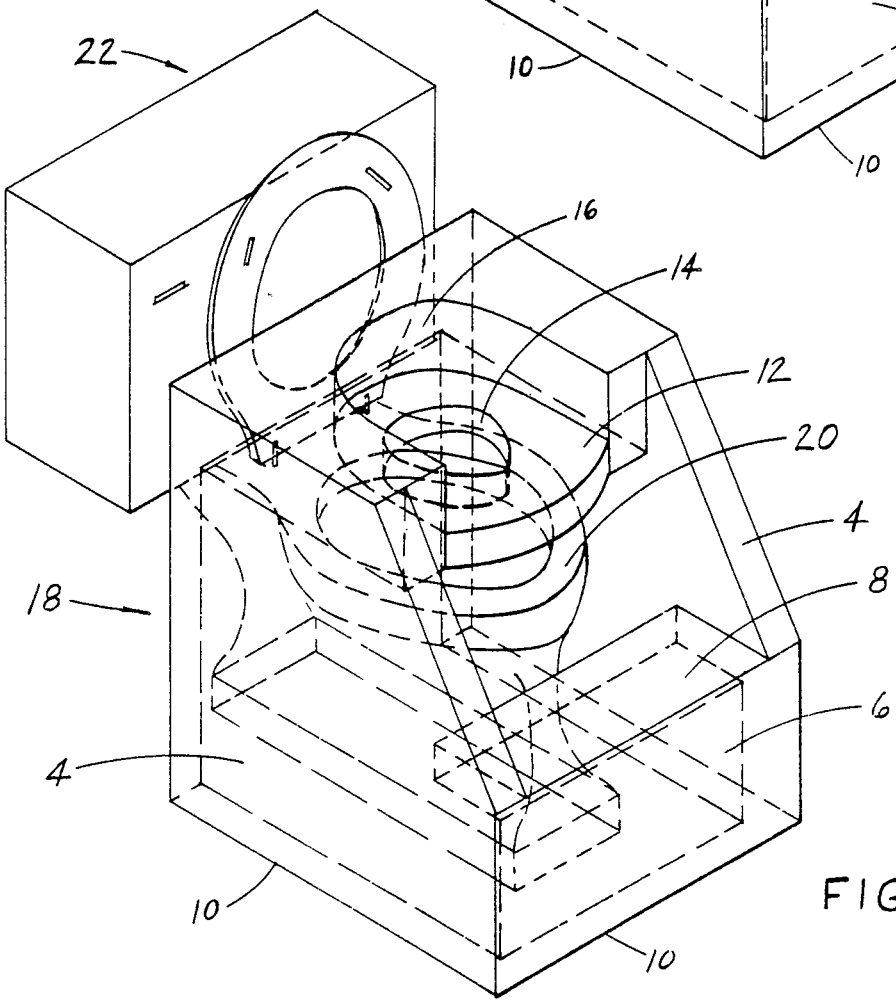
FIG. 2

PORTABLE TOILET SEAT UNIT

BACKGROUND—FIELD OF INVENTION

This invention relates to portable toilet seat units, specifically to such units which are used as portable accessories to permanently installed flushing toilets.

BACKGROUND—DESCRIPTION OF PRIOR ART

Very young children need a special toilet seat which not only conforms to their small size, but also feels safe to them when they climb onto it. If the unit moves or slips even slightly under their weight, they are likely to be afraid to get on it for fear of falling. Their lack of confidence in the unit, which is new to them, can substantially inhibit the progress of successful toilet training.

Anything that makes toilet training more difficult may also be expected to have a harmful effect on the environment, since it prolongs the use of plastic disposable diapers and thereby increases the total environmental load of solid non-degradable waste.

Inventors have created several types of toilet seat units for children. U.S. Pat. No. 2,719,305 to Lahue (1952) shows a unit designed to rest on the floor, however it requires being emptied by hand. U.S. Pat. No. 2,940,086 to Wondrack (1957) shows a device designed to discharge the waste directly into the flushing toilet, but it tends to be shaky and unstable in use due to being supported by the toilet fixture itself, rather than being supported directly on the floor.

The chamber-pot type of unit that requires manual emptying has been more or less rendered obsolete by the advent of the disposable diaper. It is no more difficult to change and dispose of a diaper than it is to empty and clean the container. But the disposable diapers themselves have created environmental problems.

The portable units that locate their seat over the toilet bowl have the advantage of minimizing handling of waste, but their chief disadvantage lies in the difficulty of providing stability. This is due to the fact that toilets have not been designed for the purpose of firmly supporting a portable toilet seat. They tend to be rounded, smooth, resistant to fastening devices, etc.

Consequently these units have tended to complexity, while still failing to provide a child with the stability and rigidity needed to give confidence. Several varieties of portable toilet seats for children have been proposed—for example U.S. Pat. Nos. 2,513,444 (1948), and 3,235,884 (1963) illustrate the chamber pot types. These must be manually emptied and cleaned. U.S. Pat. Nos. 2,517,755 (1945), 2,712,653 (1950), 2,955,296 (1958), 3,371,356 (1965), and 4,381,568 (1981) show the toilet fixture-supported types. These require varying degrees of manipulation of fasteners to apply and remove, yet are still likely to slip or shift under the weight and movement of a child.

U.S. Pat. No. 3,343,179 (1965) shows a device which may be used alternatively as either one of the two previously mentioned types, but with the same disadvantages in either case as the previously listed examples, either requiring manual emptying of waste, or lacking in stability due to being supported by the smooth, rounded, non-yielding toilet fixture. U.S. Pat. No. 2,992,439 (1960) and U.S. Pat. No. 4,777,672 (1988) show arrangements at least partly supported on the floor, whereby waste is discharged directly into the toilet, however this type also depends partly for support on the bowl or seat of the fixture, and thereby involves a shifting of the child's weight from one support system to another, contributing to instability and possibility of movement.

U.S. Pat. No. 1,638,040 (1926), French patent 1.166.849 (1958) and U.S. Pat. No. 3,215,469 (1965) all show accessories with cantilevered footrests. These are unstable for climbing and standing, depending only on the weight of the device itself to counterbalance a tendency to tilt forward if the child should attempt to use the cantilevered footrest for a step. And U.S. Pat. No. 3,588,927 (1968) also does not disclose any adequate step means.

All the portable toilet seat units heretofore known suffer from a number of disadvantages:

(a) If supported completely or partially by the toilet fixture itself, they tend to be shaky and to feel unstable.

(b) If they are the chamber pot type, they require manual emptying of waste.

(c) They are complicated to apply and remove, involving manipulation of fasteners and adjusting devices.

(d) Due to their complex shape and configuration they are difficult to clean.

(e) Due to their complexity they require varying degrees of assembly by the consumer.

(f) Multiple moving and adjustable parts can be unsafe for children, causing pinched fingers, etc.

(g) If supported independently over a toilet, they have failed to provide step means with stability when the child first climbs onto them.

OBJECTS AND ADVANTAGES

Accordingly, several objects and advantages of the present invention are:

(a) To provide a firm, stable, non-shifting toilet seat unit upon which a child may climb, move, and sit with confidence.

(b) To provide the convenience of having the waste discharged directly into the toilet.

(c) To provide a simple unit which a child may apply and remove easily.

(d) To provide a smooth continuous surface which facilitates cleaning.

(e) To provide a completely pre-assembled unit.

(f) To provide a unit of one-piece construction for maximum safety.

Further objects and advantages are to provide a unit which can be used and re-used easily and conveniently by a child or an adult, which has an attractive appearance, and which enhances toilet training by increasing the child's confidence, and which indirectly benefits the environment by reducing the demand for disposable plastic diapers. Still further objects and advantages will become apparent from a consideration of the ensuing description and drawings.

DRAWING FIGURES

FIG. 1 shows the portable toilet seat unit, the embodiment of this invention.

FIG. 2 shows the placement of the unit of FIG. 1 in relation to a conventional flushing toilet, when the unit is in position to be used.

REFERENCE NUMERALS IN DRAWINGS

4: side slabs
6: front slab
8: step

10: continuous base
12: seat
14: opening
16: backrest
18: portable toilet seat unit
20: bowl of toilet
22: toilet

DESCRIPTION—FIG. 1

A typical embodiment of the portable toilet seat unit of the present invention is illustrated in FIG. 1.

Two parallel slabs (4) are placed vertically, and joined in front by an inverted L-shaped slab (6) which forms a step (8) and a continuous base (10), and above by a contoured seat (12) having a central opening (14) and a semi-annular back rest (16).

In the preferred embodiment, the unit is constructed of a rigid low-density to medium-density plastic material, hollow molded in one piece by the rotational molding method.

OPERATION—FIG. 2

The manner of using the portable toilet seat unit (18) is as follows:

One simply lifts it up and places it into position, or pushes it into position, over the bowl (20) of the conventional toilet.

The continuous base (10) rests directly on the floor on both sides and in front of the toilet fixture, and provides a wide, firm, stabilizing base that completely supports the weight of the unit and that of a human supported by the unit, and no weight rests on the toilet while at the same time providing a stabilized step.

SUMMARY, RAMIFICATIONS, AND SCOPE

Accordingly, the reader will see that by making the seat independently supported instead of having it rest on the toilet, the portable toilet seat unit of this invention facilitates toilet training of children by providing the stability needed to give confidence to the child, and also by being simple to apply and to remove. And by enhancement of toilet training generally, it benefits the environment by reducing the amount of solid waste due to plastic disposable diapers. In addition, the unit has the convenience of being located over the toilet itself, so that no manual emptying of waste is necessary. Furthermore, the portable toilet seat unit has the additional advantages in that

- it provides a unit which is pre-assembled for the consumer;
- it provides a unit which is easy to clean;
- it provides a unit which permits random movement of the child without transmitting lateral forces to the toilet, thereby preventing stress at the base of the fixture which could tend to loosen it; and
- it provides a unit which is safe, by having no moving, adjustable or breakable parts.

Although the description above contains many specificities, these should not be construed as limiting the scope of the invention but as merely providing illustrations of some of the presently preferred embodiments of this invention. For example, the unit can also be applied to use by adults who have special needs, such as handicapped people, hospital patients, etc.

Thus the scope of the invention should be determined by the appended claims and their legal equivalents, rather than by the examples given.

I claim:

1. A portable accessory for use with an installed toilet having a top rim defining a bowl opening, comprising:

a. a toilet seat defining a central opening substantially smaller than said bowl opening, b. step means for climbing and standing on, c. support means which rest on a floor surface, and which are rigidly connected to said step means, and which support said seat horizontally over said toilet, and which support the weight of said portable accessory and a user independently of said toilet, all at the same time, d. stabilizing means being that portion of said support means which contacts said floor surface, acting independently of the weight of said accessory and substantially extended to contact said floor surface so as to prevent said accessory from tilting when weight is placed on said step means, and wherein the toilet seat, step means, support means and stabilizing means are molded together as a one piece unit.

2. The accessory of claim 1 wherein said accessory is formed of hollow molded plastic material.

3. The accessory of claim 1 wherein said accessory is formed essentially of a single continuous piece of rigid material.

4. The accessory of claim 3 wherein said accessory is formed of hollow molded plastic material.

5. A portable accessory for use with an installed toilet having a top rim defining a bowl opening comprising:

a. a toilet seat defining a central opening substantially smaller than said bowl opening, b. step means for climbing and standing on, c. support means which rest on a floor surface, and which are rigidly connected to said step means, and which support said seat horizontally over said toilet, and which support the weight of said portable accessory and a user independently of said toilet, all at the same time, d. stabilizing means being that portion of said support means which contacts said floor surface, extended to contact said floor surface at points where upward reactions to the weight of said user on said step means substantially oppose a tendency for said accessory to tilt under said weight, and wherein the toilet seat, step means, support means and stabilizing means are molded together as a one piece unit.

6. The accessory of claim 5 wherein said accessory is formed of hollow molded plastic material.

7. The accessory of claim 5 wherein said accessory is formed essentially of a single continuous piece of rigid material.

8. The accessory of claim 7 wherein said accessory is formed of hollow molded plastic material.

* * * * *